US007160159B2

(12) United States Patent
Webster

(10) Patent No.: US 7,160,159 B2
(45) Date of Patent: Jan. 9, 2007

(54) DRIVE APPARATUS

(75) Inventor: John R Webster, Derby (GB)

(73) Assignee: Rolls-Royce plc, London (GB)

( * ) Notice: Subject to any disclaimer, the term of this patent is extended or adjusted under 35 U.S.C. 154(b) by 0 days.

(21) Appl. No.: 11/282,711

(22) Filed: Nov. 21, 2005

(65) Prior Publication Data

US 2006/0105646 A1 May 18, 2006

Related U.S. Application Data

(63) Continuation of application No. PCT/GB04/02175, filed on May 20, 2004.

(51) Int. Cl.
*B63H 21/22* (2006.01)

(52) U.S. Cl. ..... 440/1

(58) Field of Classification Search ..... 440/1, 440/38

See application file for complete search history.

(56) References Cited

U.S. PATENT DOCUMENTS

| | | | | |
|---|---|---|---|---|
| 3,910,216 | A | 10/1975 | Shultz | |
| 4,100,877 | A | 7/1978 | Scott | |
| 4,392,832 | A | 7/1983 | Moberg | |
| 4,961,484 | A * | 10/1990 | Kato et al. | 192/3.31 |
| 5,413,512 | A | 5/1995 | Belenger | |
| 5,439,346 | A * | 8/1995 | Bowser et al. | 415/18 |
| 5,618,211 | A | 4/1997 | Bourgoin | |
| 5,664,534 | A | 9/1997 | Schmitz | |
| 5,711,404 | A | 1/1998 | Lee | |
| 5,971,821 | A | 10/1999 | Hultsch | |
| 7,018,324 | B1 * | 3/2006 | Lin | 482/63 |

FOREIGN PATENT DOCUMENTS

| | | |
|---|---|---|
| DE | 4 333 351 A | 4/1995 |
| GB | 2 164 410 A | 3/1986 |
| JP | 60012393 A | 1/1985 |
| JP | 60012393 B | 1/1985 |
| JP | 7 309 295 A | 11/1995 |
| JP | 7 309 295 B | 11/1995 |
| JP | 2004011459 A | 1/2004 |
| JP | 2004011459 B | 1/2004 |

* cited by examiner

*Primary Examiner*—Stephen Avila
(74) *Attorney, Agent, or Firm*—W. Warren Taltavull; Manelli Denison & Selter PLLC

(57) ABSTRACT

A drive apparatus (10) for propelling a vehicle across a body of water is described. The apparatus (10) comprises a prime mover, for example a gas turbine engine (12), and a propelling arrangement (26) driven by the prime mover for propelling the vehicle across the body of water and thereby provide a reaction force on the prime mover. The apparatus (10) also includes a braking arrangement (42) to apply a braking force to the propelling arrangement (26).

19 Claims, 3 Drawing Sheets

DRIVE APPARATUS

This is a continuation of International Application No. PCT/GB2004/002175 filed May 20, 2004 which designating the U.S.

FIELD OF THE INVENTION

This invention relates to drive apparatus. More particularly, this invention relates to drive apparatus for propelling vehicles across a body of water.

BACKGROUND OF THE INVENTION

Ships which comprise propulsion assemblies having water jet drive systems can suffer from the problem of air ingestion into the water jet, or, in the case of propellers, when the propeller lifts out of the water. This is referred to as "broaching". Such ingestion or broaching can cause a sudden drop in load on the engine and on the drive system, which can lead to problems. One way of attempting to overcome this problem is by the use of an engine fuel cut-off when the effects of such air ingestion or broaching are detected. This mechanical cycling can lead to a reduction in the life of the components and the need to design stronger and, hence, heavier and more expensive components.

In the case of fast ships, air ingestion can occur for a substantial part of this operation and, thus, any detrimental effect will be significantly increased.

SUMMARY OF THE INVENTION

According to one aspect of this invention there is provided a drive apparatus for propelling a vehicle across a body of water, comprising a prime mover to provide a driving force, a propelling arrangement driven by the driving force for propelling the vehicle across the body of water, thereby producing a load in reaction to the driving force, and a braking arrangement to apply a braking force to the propelling arrangement.

Preferably, the braking arrangement is adapted to apply said braking force to maintain the driving force substantially constant.

Preferably, the braking arrangement can apply the braking force on a reduction of the load, where said reduction is effected from the propelling arrangement.

Preferably, the drive apparatus comprises a control system to control the operation of the braking arrangement. The control system may include a sensor to sense a reduction in said load. Preferably the sensor can sense said reduction in said reaction force directly, for example by measuring said force, or indirectly, for example by sensing the presence of air in the propelling arrangement.

The propelling arrangement may comprise a transmission assembly and a propulsor. The transmission assembly may be arranged to transmit the driving force from the prime mover to the propulsor. The transmission assembly may comprise a shaft and a gear assembly. The gear assembly may be arranged in operative engagement between the shaft and the drive means.

The prime mover may comprise an engine, for example a gas turbine engine or a diesel engine. The engine may comprise a gas generator to generate gas at suitably high pressures, and may also include a turbine, for example a free power turbine to drive the propelling arrangement.

The propulsor preferably comprises a water jet or a propeller. The propulsor may comprise a plurality of water jets or a plurality of propellers.

In one embodiment the braking arrangement may comprise an eddy current device. The braking arrangement may comprise a disc formed of a suitable metallic material such as aluminium, and a plurality of magnets arranged around the disc on each side. Preferably, the magnet comprises electromagnets.

In another embodiment, the braking arrangement may comprise a rotor wheel having movably mounted thereon a magnet. The magnet may be radially movable in relation to the rotor wheel.

The braking arrangement may further include a decelerating assembly, which may comprise an electrical conductor, whereby when the magnet moves into operational proximity to the decelerating assembly, an electrical current through the electrical conductor applies a force to the magnet, said force being such as to decelerate the rotor wheel.

BRIEF DESCRIPTION OF THE DRAWINGS

An embodiment of the invention will now be described by way of example only, with reference to the accompanying drawing, in which.

DETAILED DESCRIPTION OF THE INVENTION

Figure 1:
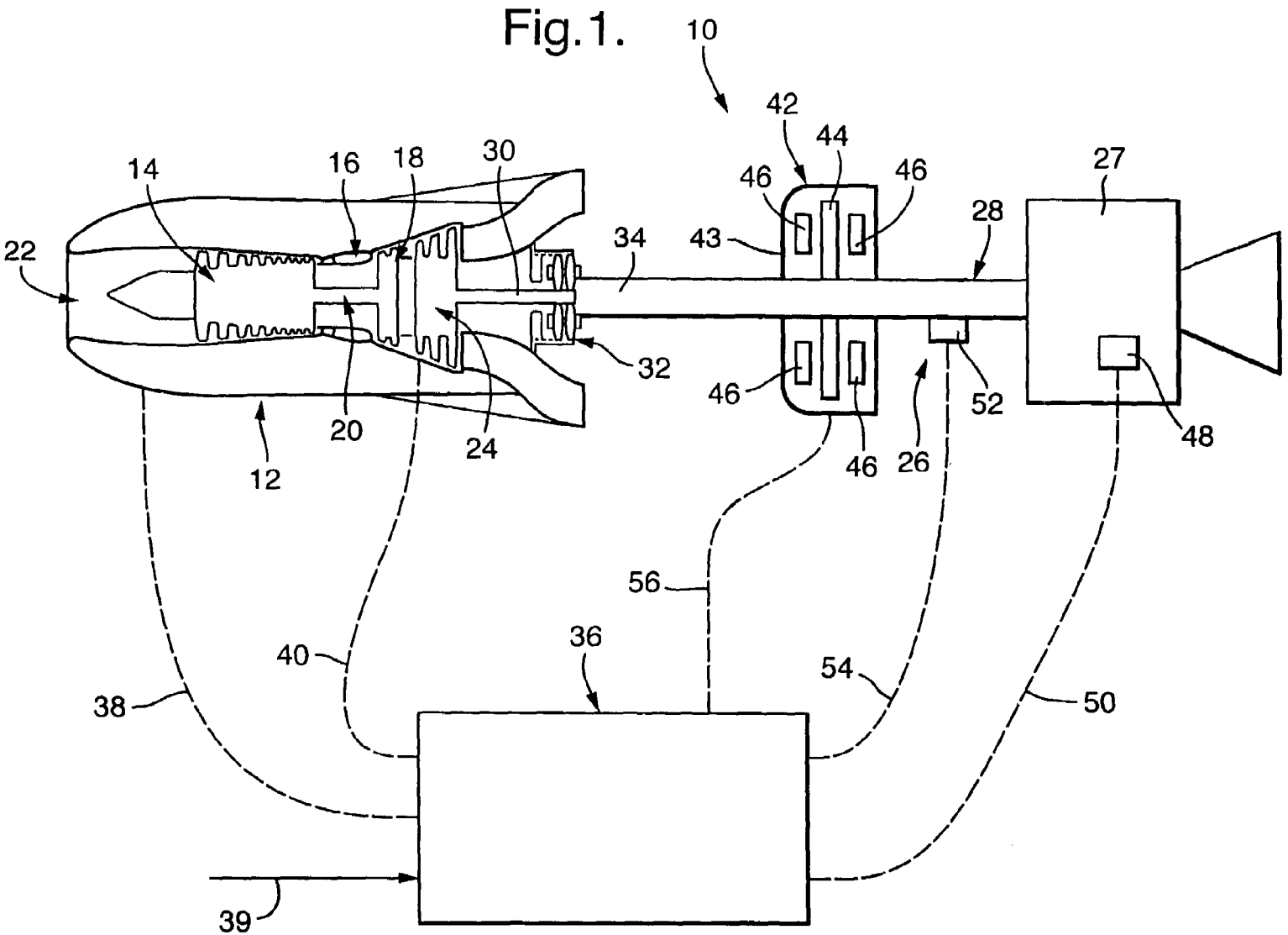
FIG. 1 is a schematic diagrammatic representation of a sectional side view of one embodiment of a drive apparatus.

Referring to FIG. 1 of the drawings, there is shown a drive apparatus 10 for use in a vehicle such as a boat or ship(s) to propel the vehicle across a body of water. The drive apparatus 10 comprises a prime mover in the form of a gas turbine engine 12. The gas turbine engine 12 is of known for and provides, in axial flow series a compressor arrangement 14, a combustor 16 and a turbine arrangement 18 shaft arrangement 20 interconnects the compressor arrangement 14 with the turbine arrangement 18. An air intake 22 is provided at the upstream end region of the engine 12.

Air entering the intake 22 is compressed by the compressor arrangement 14, so that air exhausted from the compressor arrangement 14 is directed into the combustor 16 where it is mixed with fuel and the mixture combusted. The resultant hot combustion products then expand through and, thereby, drive the turbine arrangement 18.

Downstream of a turbine arrangement 18 there is provided a free power turbine assembly 24, which is driven by gases exhausted from the turbine arrangement 18.

The free power turbine 24 is connected to a propelling arrangement 26 which comprises a propulsor in the form of a water jet 27 and a transmission means 28. The transmission means 28 comprises a coupling shaft 30 and a gear assembly 32. The coupling shaft 30 extends from the free power turbine 24 to the gear assembly 32. It will be appreciated that the propulsor could be in the form of a propeller.

The transmission arrangement 28 also comprises a power output shaft 34 which extends from the gear arrangement 32 to the water jet 27. The water jet 27 drives water rearwardly to drive the vehicle forwards. The driving of the water creates a reaction force in the form of torque on the transmission arrangement. This reaction force is transmitted back to the prime mover.

The operation of the gas turbine engine 12 as described above is controlled by a control system which is shown schematically in the drawing and designated by the numeral 36. The control system 36 is connected to the gas turbine engine 12 by a first connection, as represented by the broken line designated 38. A demand signal 39, for example for an increase in speed, is received by the control arrangement 36, which transmits an appropriate signal via the connection 38 in a known manner.

In addition, the control means 36 is connected to the free power turbine 24, by a second connection, as represented by the broken line 40. In the embodiment shown, a speed sensor (not shown) measures the speed of the free power turbine 24 and sends an appropriate signal to the control means 36. The control means 36 can then, if necessary, adjust the signal fed to the gas turbine engine 12 via the connection 38.

Figure 3:
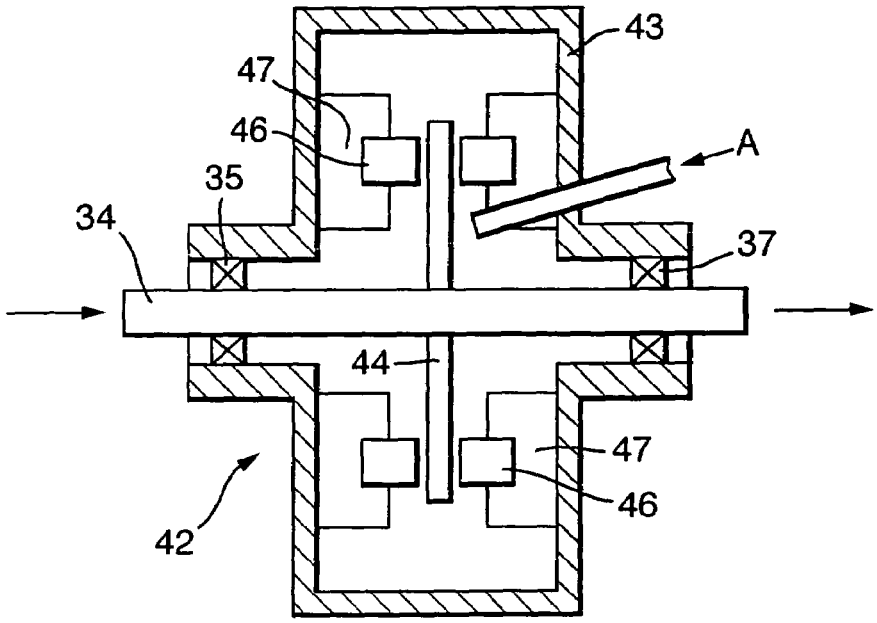
FIG. 3 shows a braking arrangement suitable for use in the embodiment shown in FIG. 1.

In operation, air exhausted from the turbine arrangement 18 drives the free power turbine 24. The power output from the free power turbine 24 is transmitted via the coupling shaft 30 to the gear arrangement 32 and thereafter to the power output shaft 34. The rotation of the power output shaft 34 drives the water jet 27. As will be appreciated, the power of the water jet 27 creates a reaction force on the power output shaft 34. In the event of air entering the water jet 27, the reaction force is reduced which can lead to a sudden reduction in shaft torque and an increase in speed of the free power turbine 24 and the propelling arrangement 26. In order to attempt to mitigate this problem, a braking arrangement 42, which in the embodiment shown in FIG. 3, is in the form of an eddy current device, is provided. The braking arrangement 42 comprises a housing 43 in which is mounted a disc 44 which may be formed of a suitable metal, for example aluminium, and a plurality of electromagnets 46 arranged on each side of the disc 44.

In the example of the braking arrangement shown in FIG. 3, the output shaft 34 journalled within bearings 35 mounted in the housing 43.

A cooling conduit 45 extends through the housing 43 to supply a cooling fluid, for example air or water to the disc 44, as shown by the arrow A.

The electromagnets 46 are mounted on suitable supports 47. The electrical power transmitted to the electromagnetics is variable and dependent upon the extent to which the shaft torque decreases. Thus, the appropriate amount of power is supplied to the electromagnets 46 to provide a braking force which maintains the driving force substantially constant.

A sensor 48 may be provided in the water jet 27 to detect the presence of air therein. The sensor 48 is connected to the control system 36 by a third connection, as represented by the broken line designated 50. Alternatively, the sensor could be in the form of a torque sensor 52 arranged between the braking assembly 42 and the water jet 27 to sense the torque on the power output shaft 38. In the event of air entering the water jet 27, there would be a decrease in the torque of the output power shaft 34. The torque sensor 52 is electrically connected to the control means 36 by a fourth connection, as represented by the broken line designated 54.

The use of the air sensor 48 to detect air entering the water jet 27 would provide the advantage of early detection of air ingestion, and would allow the use of a slower acting brake arrangement 42. However, the use of a torque sensor 52 would give more direct feedback of the change in torque on the output power shaft 34.

The control means 36 is connected to the braking assembly 42 by a fifth connection, as represented by the broken line designated 56. On detecting air entering the water jet 27 the air sensor 48 would transmit a signal via the third connection 50 to the control means 36. The control means 36 would then transmit a signal to the braking assembly 42 via the fifth connection 56 to apply a braking force to the power output shaft 34. In effect, the braking force would be a replacement for the reduction in torque due to air ingestion by the water jet 27.

In the case of the torque sensor 52, air entering the water jet 27 would cause a reduction in the torque on the power transmission shaft 34 and this would be sensed by the torque sensor 52 which would transmit a signal via the fourth connection 54 to the control means 36. The control means 36 would then transmit a signal to the braking means 42 via the fifth connection 56 to apply the braking force to the power output shaft 34. Suitable feedback arrangements could be provided to ensure that the braking force applied is of a comparable size to the reduction in the torque on the power output shaft 34.

Figure 4:
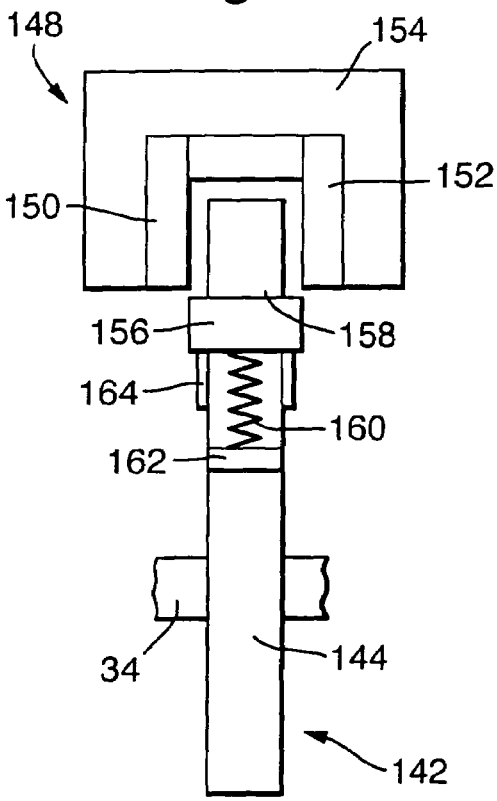
FIG. 4 shows a further embodiment of a braking arrangement in a normal operating condition.
Figure 5:
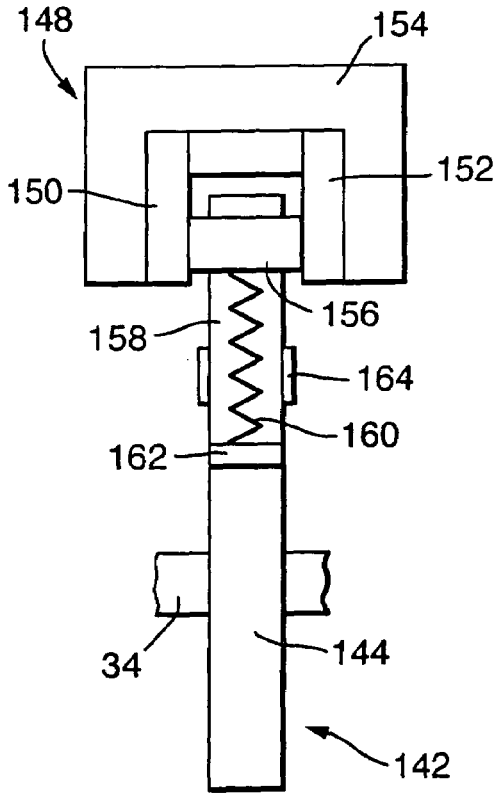
FIG. 5 shows the embodiment of FIG. 4 in an overspeed condition.

A further braking arrangement 142 is shown in FIGS. 4 and 5, in which the output shaft 34 is connected to a rotor wheel 144.

The rotor wheel 144 is circumferentially surrounded by a decelerating assembly 148 comprising a pair of annular electrical conductors 150, 152 arranged opposite each other or either side of the rotor wheel 144. The electrical Conductors 150, 152 are themselves surrounded by a cooling assembly in the form of a water jacket 154.

A magnet 156 is provided on or extends through an appropriate slot 158 in the rotor wheel 144. A resilient urging member in the form of a spring 160 urges the magnet 156 radially inwardly of the rotor wheel 144. The spring 160 is secured to a bar 162 fixedly mounted on the rotor wheel 144.

A pair of stop members 164 prevent the magnet 156 from moving too far radially inwardly under the urging force of the spring 160.

During normal operation, as shown in FIG. 4, the magnet 156 remains engaged with the stop members 164. However, in the event of a sudden drop in the load on the output shaft 34, for example when air enters the water jet 27. This reduction in the load causes an increase in speed of the output shaft 34 and a corresponding increase in speed of the rotor wheel 144. If the increase in speed exceeds a predetermined value, the magnet 156 moves radially outwardly against the force of the spring 160 to the position shown in FIG. 5.

In the position shown in FIG. 5, the magnet 156 is in close proximity to the electrical conductors 150, 152. An appropriate flow of electrical current is generated through the electrical conductors 150, 152 to create a decelerating force on the magnet 156 and thereby on the rotor wheel 144.

As the rotor wheel 144 decelerates, the radially outward force on the magnet 156 reduces, and the spring 160 urges the magnet 156 back into engagement with the stop members 164. Heat created at the electrical conductors 150, 152 is dissipated by the water jacket 154.

Sensors could be provided to control the amount of electricity passed to the electrical conductors 150, 152.

There is thus described an embodiment which allows a drive apparatus incorporating a propulsor to overcome problems associated with air ingestion by the water jet.

Various modifications can be made without departing from the scope of the invention, for example, the braking arrangement could comprise a combined electrical generator and an eddy current device, which would remove any need for an external power source. Alternatively, the braking arrangement could comprise a simple fly wheel, or a dynamic fly wheel which can increase its inertia by allowing radially outward movement of masses as the speed of the fly wheel increases. The prime mover could be another type of engine, for example a diesel engine.

The use of a simple flywheel would mean that it would not be necessary to incorporate control means or sensors to control the flywheel, the flywheel would automatically compensate for any sudden reduction in the driving force. An example of such an arrangement is shown in FIG. 2, which includes many of the same features as the embodiment shown in FIG. 1 and these have been labelled with the same reference numerals.

Figure 2:
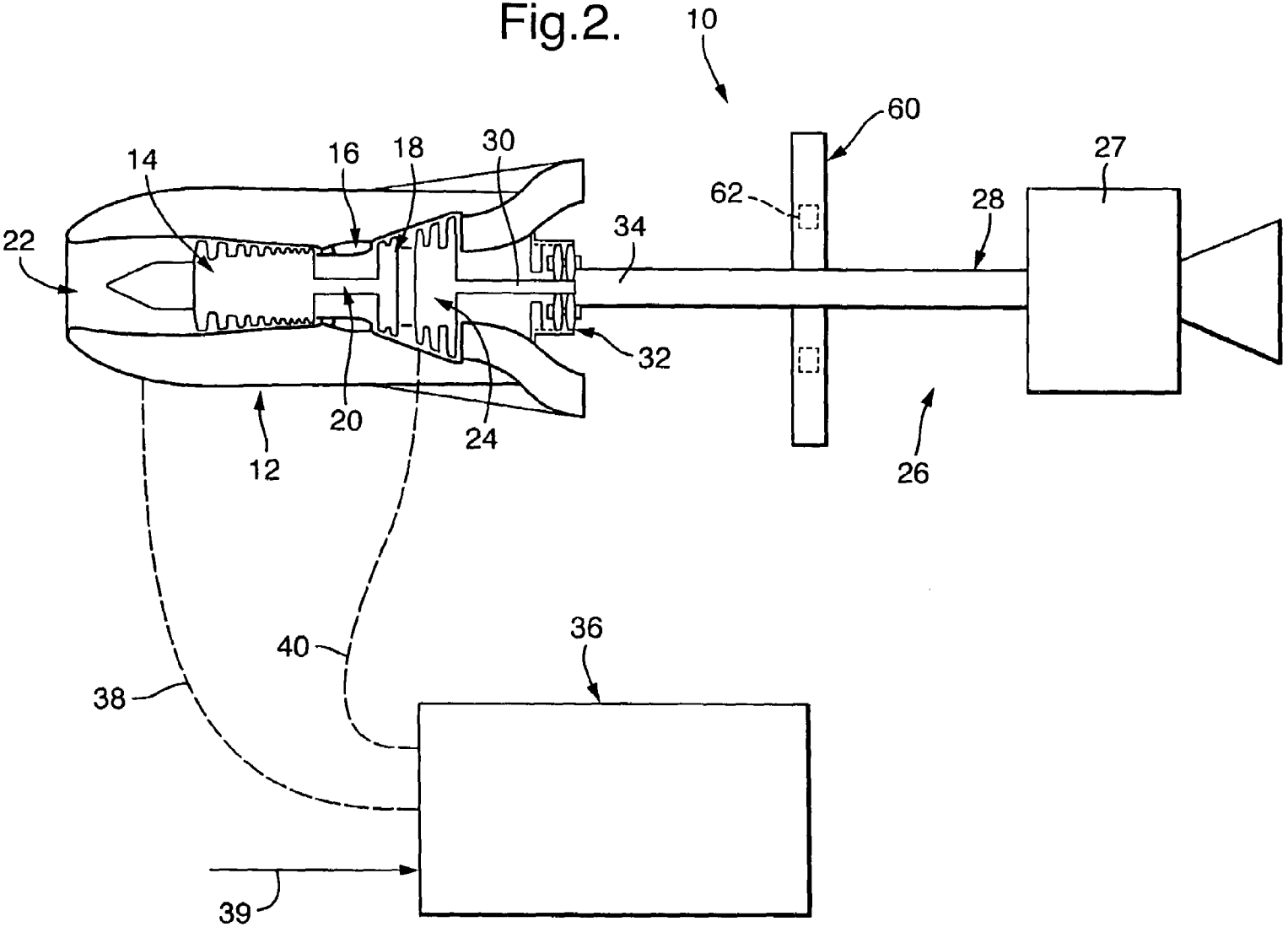
FIG. 2 is a diagram similar to FIG. 1 of another embodiment.

In FIG. 2, the flywheel is designated 60, and radially outwardly movable weights are shown in broken lines and designated 62.

Whilst endeavouring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

The invention claimed is:

1. A drive apparatus for propelling a vehicle across a body of water, comprising a prime mover to provide a driving force, a propelling arrangement driven by the driving force for propelling the vehicle across the body of water, thereby producing a load in reaction to the driving force, and a braking arrangement to apply a braking force to the propelling arrangement, the braking arrangement being arranged to apply the braking force on a reduction of the load, where said reduction is effected from the propelling arrangement wherein the drive apparatus further comprises a control system to control the operation of the braking arrangement, the control system comprising a sensor to sense a reduction in said load wherein said sensor can sense said reduction in said load directly or indirectly wherein the drive apparatus includes a driving force sensor to sense said reduction in said load directly.

2. A drive apparatus according to claim 1, wherein the braking arrangement is arranged to apply said braking force to maintain the driving force substantially constant.

3. A drive apparatus for propelling a vehicle across a body of water, comprising a prime mover to provide a driving force, a propelling arrangement driven by the driving force for propelling the vehicle across the body of water, thereby producing a load in reaction to the driving force, and a braking arrangement to apply a braking force to the propelling arrangement, the braking arrangement being arranged to apply the braking force on a reduction of the load, where said reduction is effected from the propelling arrangement wherein the drive apparatus further comprises a control system to control the operation of the braking arrangement, the control system comprising a sensor to sense a reduction in said load wherein said sensor can sense said reduction in said load directly or indirectly wherein the drive apparatus includes a water sensor to sense an ingestion of air into the propelling arrangement, thereby indirectly sensing the reduction in the driving force.

4. A drive apparatus according to claim 1, wherein the propelling arrangement comprises a transmission assembly and a propulsor, the transmission assembly being arranged to transmit the driving force from the prime mover to the propulsor.

5. A drive apparatus according to claim 4, wherein the transmission assembly comprises a shaft and a gear assembly, the gear assembly being arranged in operative engagement between the shaft (20) and the prime mover.

6. A drive apparatus according to claim 4, wherein the propulsor comprises a water jet.

7. A drive apparatus according to claim 4, wherein the propulsor comprises a propeller.

8. A drive apparatus according to claim 1, wherein the prime mover comprises an engine.

9. A drive apparatus according to claim 8, wherein the engine comprises a gas turbine engine or a diesel engine.

10. A drive apparatus according to claim 9, wherein the gas turbine engine comprises a gas generator to generate gas at a suitably high pressure, and said apparatus further includes a turbine assembly driven by said generated gas, to drive the propelling arrangement.

11. A drive apparatus according to claim 1, wherein the braking arrangement comprises an eddy current device comprising a disc formed of a suitable metallic material, and a plurality of magnets arranged around the disc on each side.

12. A drive apparatus according to claim 11, wherein the magnets comprise electromagnets.

13. A drive apparatus according to claim 12, wherein the braking arrangement comprises an electrical generator associated with said eddy current device to provide power for said electromagnets.

14. A drive apparatus according to claim 1, wherein the braking arrangement comprises a flywheel.

15. A drive apparatus according to claim 14, wherein the flywheel comprises a dynamic flywheel having a plurality of weights mounted thereon, said weights being movable radially outwardly on an increase in speed of said flywheel.

16. A drive apparatus according to claim 1, wherein the braking arrangement comprises a rotor wheel, having mounted thereon a movable magnet, and a decelerating assembly provided around a radially outer edge region of the rotor wheel, and the rotary wheel extends into the decelerating assembly.

17. A drive apparatus according to claim 16, wherein the magnet is radially movable on the rotor wheel, and the braking arrangement further includes an urging member to urge the magnet radially inwardly of the rotor wheel.

18. A drive apparatus according to claim 16, wherein the decelerating assembly comprises an electrical conductor.

19. A drive apparatus according to claim 18, wherein the rotor wheel includes a stop member thereon to restrict radial inward movement of the magnet.

* * * * *